US010591843B2

(12) United States Patent
Urayama et al.

(10) Patent No.: US 10,591,843 B2
(45) Date of Patent: Mar. 17, 2020

(54) IMAGE FORMING APPARATUS AND DEVELOPING DEVICE

(71) Applicant: FUJI XEROX CO.,LTD., Tokyo (JP)

(72) Inventors: Kenta Urayama, Kanagawa (JP); Masanori Kato, Kanagawa (JP); Tomoyuki Yoshii, Kanagawa (JP); Fumiyuki Honda, Kanagawa (JP); Shiho Matsuda, Kanagawa (JP); Yoshitaka Nakajima, Kanagawa (JP); Junichi Uchiyama, Kanagawa (JP); Norihiro Tamazawa, Kanagawa (JP); Yoshifumi Ozaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/940,983

(22) Filed: Mar. 30, 2018

(65) Prior Publication Data

US 2018/0364615 A1 Dec. 20, 2018

(30) Foreign Application Priority Data

Jun. 20, 2017 (JP) ..... 2017-120227

(51) Int. Cl.
*G03G 15/08* (2006.01)

(52) U.S. Cl.
CPC ..... *G03G 15/0812* (2013.01); *G03G 15/0815* (2013.01); *G03G 15/0808* (2013.01)

(58) Field of Classification Search
CPC ..... G03G 15/0812; G03G 15/0808
USPC ..... 399/234
See application file for complete search history.

(56) References Cited

U.S. PATENT DOCUMENTS

| | | | | |
|---|---|---|---|---|
| 4,580,888 | A * | 4/1986 | Thompson | G03G 15/0942 222/DIG. 1 |
| 5,223,898 | A * | 6/1993 | Fujii | G03G 15/09 399/254 |
| 5,953,563 | A * | 9/1999 | Yamaguchi | G03G 15/09 399/119 |
| 8,688,013 | B2 * | 4/2014 | Hayashi | G03G 15/0893 399/254 |
| 9,405,223 | B2 | 8/2016 | Oshikawa et al. | |
| 2015/0234323 | A1 * | 8/2015 | Furukawa | G03G 15/0891 399/254 |

FOREIGN PATENT DOCUMENTS

| | | |
|---|---|---|
| JP | 2007121942 | 5/2007 |
| JP | 2016001254 | 1/2016 |

* cited by examiner

*Primary Examiner* — Susan S Lee
(74) *Attorney, Agent, or Firm* — JCIPRNET

(57) ABSTRACT

An image forming apparatus includes an image carrier that holds an image, a developer carrier that holds a developer to be supplied to the image carrier, a transport member that transports the developer in an axial direction of the developer carrier, and a restraint member that restrains the developer, which has scattered as a result of being transported by the transport member, from moving toward the developer carrier.

4 Claims, 5 Drawing Sheets

IMAGE FORMING APPARATUS AND DEVELOPING DEVICE

CROSS-REFERENCE TO RELATED APPLICATIONS

This application is based on and claims priority under 35 USC 119 from Japanese Patent Application No. 2017-120227 filed Jun. 20, 2017.

BACKGROUND

(i) Technical Field

The present invention relates to an image forming apparatus and a developing device.

(ii) Related Art

If a developer that has been separated from a developer carrier, which supplies the developer to an image carrier, adheres to the developer carrier again, this may lead to degradation of image quality such as, for example, a decrease in image density. Thus, it is desirable to reduce the amount of the developer that adheres to the developer carrier again.

SUMMARY

According to an aspect of the invention, there is provided an image forming apparatus including an image carrier that holds an image, a developer carrier that holds a developer to be supplied to the image carrier, a transport member that transports the developer in an axial direction of the developer carrier, and a restraint member that restrains the developer, which has scattered as a result of being transported by the transport member, from moving toward the developer carrier.

BRIEF DESCRIPTION OF THE DRAWINGS

Exemplary embodiments of the present invention will be described in detail based on the following figures, wherein.

DETAILED DESCRIPTION

Figure 1:
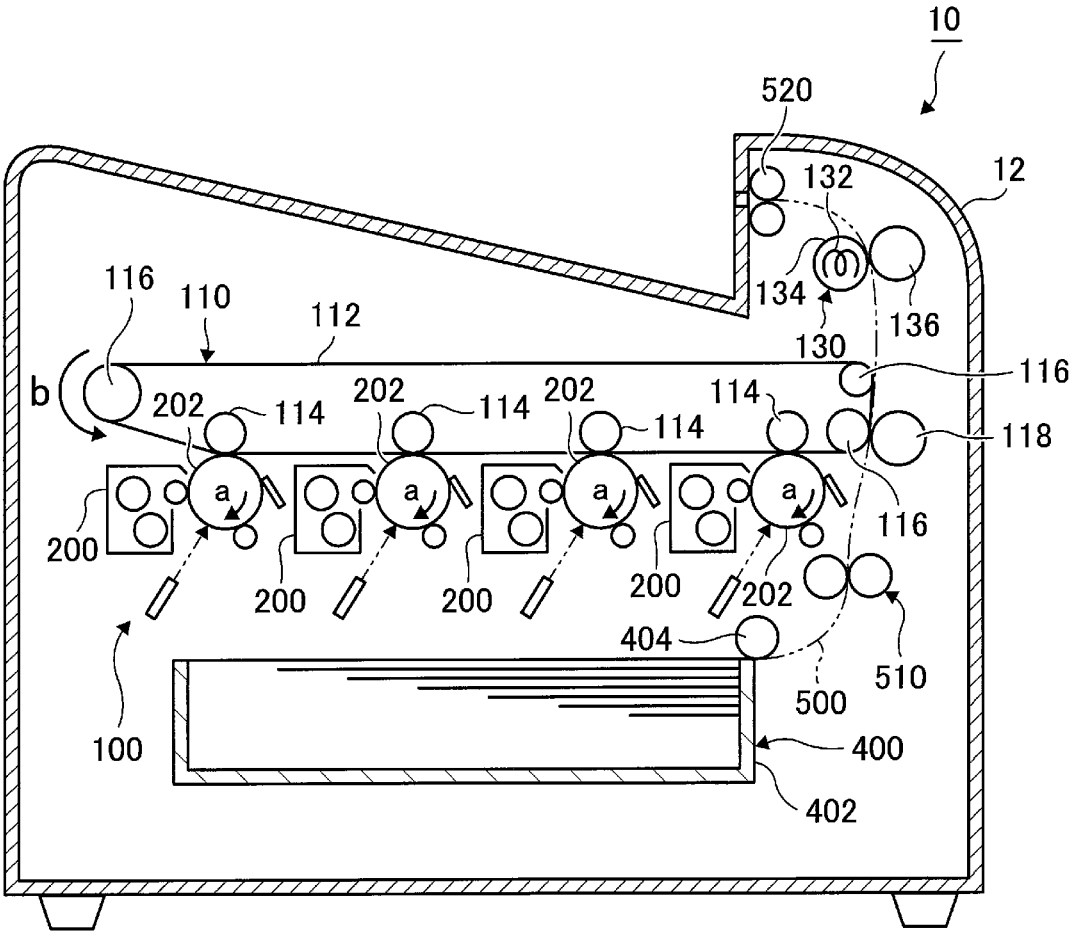
FIG. 1 is a diagram illustrating a schematic configuration of an image forming apparatus according to a first exemplary embodiment of the present invention.

Exemplary embodiments of the present invention will be described in detail below with reference to the drawings. FIG. 1 illustrates an image forming apparatus 10 according to a first exemplary embodiment of the present invention.

As illustrated in FIG. 1, the image forming apparatus 10 includes an image forming apparatus body 12, and an image forming unit 100 that forms an image, a supply device 400, and a transport path 500 are disposed in the image forming apparatus body 12.

The image forming unit 100 includes, for example, four toner-image forming units 200. The four toner-image forming units 200 form toner images of different colors such as, for example, yellow, magenta, cyan, and black. In addition, each of the toner-image forming units 200 includes a photoconductor drum 202 that is an example of an image carrier, which holds an image, and that has a surface on which a toner image is to be formed. Each of the photoconductor drums 202 rotates in the direction of arrow a. Note that details of the toner-image forming units 200 will be described later.

The image forming unit 100 further includes a transfer device 110. The transfer device 110 includes an intermediate transfer body 112 having, for example, an endless loop shape and four first transfer members 114 each of which corresponds to one of the four toner-image forming units 200.

The intermediate transfer body 112 is stretched by the four first transfer members 114 and, for example, three support rollers 116 and moves in the direction of arrow b.

Each of the first transfer members 114 has, for example, a roll-like shape and is disposed in such a manner as to face a corresponding one of the photoconductor drums 202 with the intermediate transfer body 112 interposed therebetween. In addition, a first transfer bias is applied to the first transfer members 114 so as to transfer toner images formed on the photoconductor drums 202 onto the intermediate transfer body 112.

The transfer device 110 further includes a second transfer member 118. The second transfer member 118 has, for example, a roll-like shape and is disposed in such a manner as to face one of the support rollers 116 with the intermediate transfer body 112 interposed therebetween. A second transfer bias is applied to the second transfer member 118 so as to transfer toner images that have been transferred from the four photoconductor drums 202 to a surface of the intermediate transfer body 112 in a first transfer process in such a manner as to be superposed with one another onto a recording medium such as, for example, a sheet.

The image forming unit 100 further includes a fixing device 130. The fixing device 130 includes a heating roller 134 that is provided with a heat source 132 and a pressure roller 136 that presses a recording medium against the heating roller 134. The fixing device 130 fixes toner images onto a recording medium by using heat and pressure.

The supply device 400 is a device that supplies recording media to the image forming unit 100 and includes an accommodating unit 402 in which the recording media are stacked on top of one another and a delivery roller 404 that sends out the recording media accommodated in the accommodating unit 402 toward the image forming unit 100.

One of the recording media that is sent out from the supply device 400 is transported along the transport path 500 toward the image forming unit 100, and one of the recording media on which an image has been formed by the image forming unit 100 is also transported along the transport path 500 to the outside of the image forming apparatus body 12. The above-mentioned delivery roller 404, a pair of registration rollers 510, the above-mentioned second transfer member 118, the above-mentioned fixing device 130, and a pair of ejection rollers 520 are disposed along the transport path 500 in this order starting from an upstream side in a transport direction of the recording media.

The registration rollers 510 cause an end of one of the recording media to temporarily stop moving and then cause the end of the recording medium to resume its movement in accordance with the timing at which an image is formed by the image forming unit 100.

The ejection rollers 520 eject one of the recording media to which toner images have been fixed by the fixing device 130 to the outside of the image forming apparatus body 12.

As described above, in the image forming apparatus 10, the image forming unit 100 forms toner images onto one of the recording media supplied by the supply device 400, and the recording medium on which the toner images have been formed is ejected to the outside of the image forming apparatus body 12.

Figure 2:
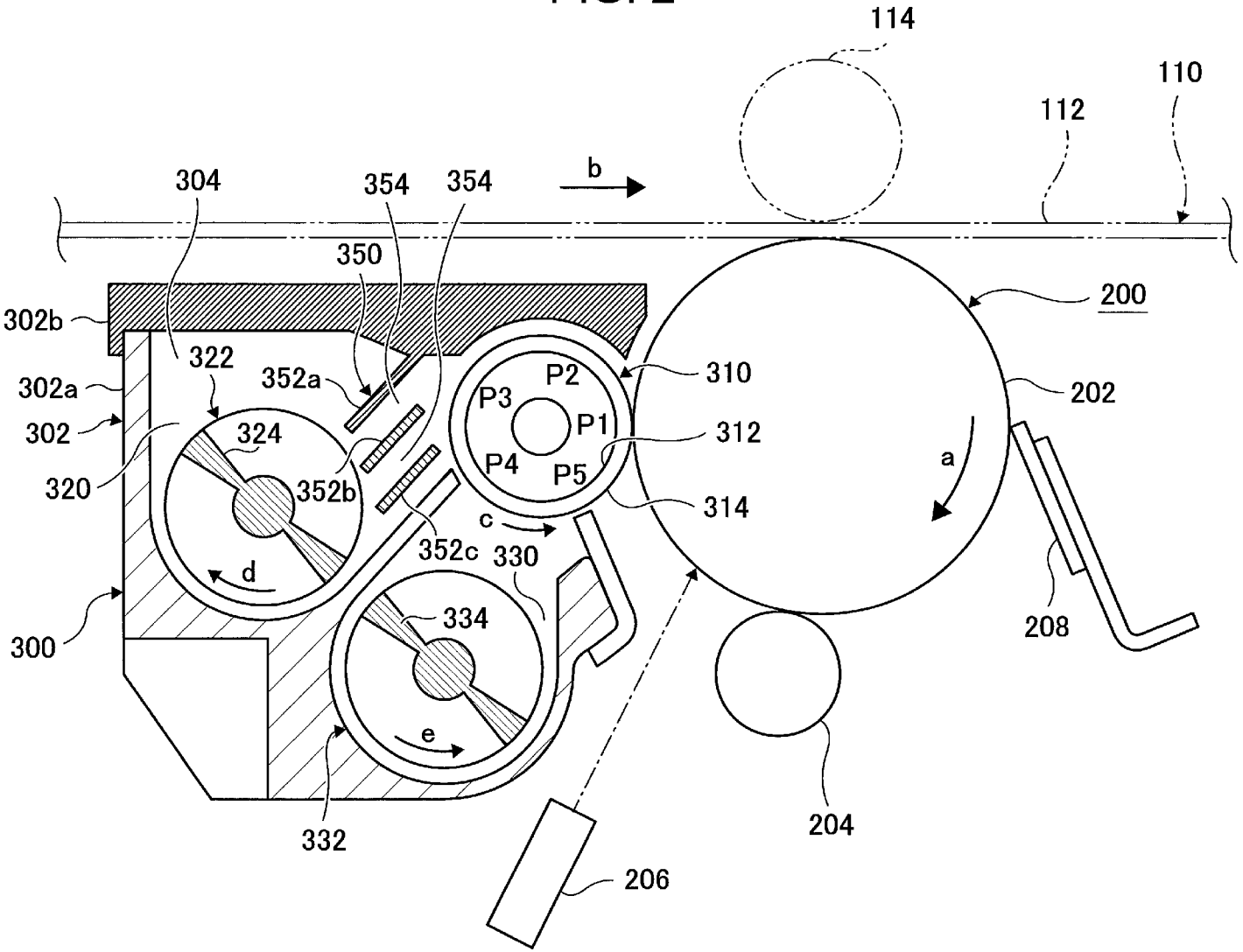
FIG. 2 is a cross-sectional view illustrating an example of one of toner-image forming units included in the image forming apparatus illustrated in FIG. 1.

FIG. 2 illustrates one of the toner-image forming units 200. As illustrated in FIG. 2, the toner-image forming unit 200 includes the above-mentioned photoconductor drum 202 and also includes a charging device 204 that charges the photoconductor drum 202, a latent-image forming device 206 that forms a latent image onto a surface of the photoconductor drum 202, the surface having being charged by the charging device 204, by, for example, radiating light, a developing device 300 that develops a latent image formed by the latent-image forming device 206 into a toner image with a two-component developer, and a cleaning device 208 that cleans the surface of the photoconductor drum 202 after the toner image has been transferred in the first transfer process to the intermediate transfer body 112.

The developing device 300 is a device that develops a latent image by using a developer that is a mixture of a non-magnetic toner that is charged so as to have, for example, a negative polarity and a magnetic carrier that is charged so as to have, for example, a positive polarity. The developing device 300 includes a developing device body 302, and a developing roller 310 is disposed in the developing device body 302. Here, the developing roller 310 is an example of a developer carrier that holds the developer to be supplied to the image carrier (the photoconductor drum 202).

The developing device body 302 includes a first body portion 302*a* and a second body portion 302*b*. A cavity 304 whose upper portion in the direction of gravity is open is formed in the first body portion 302*a*. The second body portion 302*b* is capable of being mounted onto and unmounted from the first body portion 302*a*, and when the second body portion 302*b* is in a state of being mounted on the first body portion 302*a*, the cavity 304 is sealed with the second body portion 302*b*. In other words, the second body portion 302*b* is used as a lid that is placed onto the cavity 304.

The developing roller 310 includes a magnet member 312 having, for example, a columnar shape and a developing sleeve 314 having, for example, a cylindrical shape. The developing sleeve 314 covers the magnet member 312 and rotates in the direction of arrow c while being supported by the magnet member 312.

The magnet member 312 includes, for example, five magnetic poles. More specifically, the magnet member 312 includes, for example, a development magnetic pole P1, which is the N pole, a transport magnetic pole P2, which is the S pole, a separation magnetic pole P3, which is the N pole, a separation magnetic pole P4, which is the N pole, and an attraction magnetic pole P5, which is the S pole.

The development magnetic pole P1 is disposed downstream from the attraction magnetic pole P5 in a direction of rotation of the developing sleeve 314 in such a manner as to face a movement region in which the toner is moved from a surface of the developing sleeve 314 to the photoconductor drum 202. The development magnetic pole P1 is used for forming a magnetic brush formed of the toner in the vicinity of the photoconductor drum 202 and developing a latent image, which has been formed on the surface of the photoconductor drum 202, by using the toner.

The transport magnetic pole P2 is disposed downstream from the development magnetic pole P1 in the direction of rotation of the developing sleeve 314 and used for maintaining the developer in a state of being attracted to the surface of the developing sleeve 314 so that the developer is transported along with rotation of the developing sleeve 314.

The separation magnetic pole P3 and the separation magnetic pole P4 are adjacent to each other and have the same polarity, which is the N pole, as mentioned above. The separation magnetic pole P3 and the separation magnetic pole P4 cause the developer to separate from the surface of the developing sleeve 314 by generating a repulsive magnetic force.

The attraction magnetic pole P5 is used for attracting the developer that has been transported toward the developing roller 310 by a first transport unit 322, which will be described below, to the surface of the developing sleeve 314.

A first stirring chamber 320 used for transporting and stirring the developer is formed in the developing device body 302, and the first transport unit 322 is disposed in the first stirring chamber 320.

The first transport unit 322 is an example of a transport member that transports the developer in the axial direction of the developer carrier (the developing roller 310). The first transport unit 322 rotates in the direction of arrow d and transports the developer in such a manner that the developer is pushed out by a helical blade 324. More specifically, in the first stirring chamber 320, the first transport unit 322 transports the developer from the near side to the far side as viewed in FIG. 2.

A second stirring chamber 330 used for transporting and stirring the developer is also formed in the developing device body 302, and the second transport unit 332 is disposed in the second stirring chamber 330.

The second transport unit 332 rotates in the direction of arrow e and transports the developer in such a manner that the developer is pushed out by a helical blade 334. More specifically, in the second stirring chamber 330, the second transport unit 332 transports the developer from the far side to the near side as viewed in FIG. 2 and moves the developer toward the developing roller 310 (upward in FIG. 2).

In the developing device 300, which has the above-described configuration, there is a possibility that the developer that has moved away from the vicinity of the separation magnetic pole P3 and the separation magnetic pole P4 of the developing roller 310 will scatter in the developing device body 302 as a result of being transported by the first transport unit 322 or will be made to flow back toward the developing roller 310 while being transported by the first transport unit 322, and accordingly, there is a possibility that the developer that has scattered in the developing device body 302 or the developer that has been made to flow back toward the developing roller 310 will adhere to the developing roller 310 again.

The developer that has adhered to the developing roller 310 again has not yet been stirred by either the first transport unit 322 or the second transport unit 332, and thus, if such a developer is used in a developing operation, this may lead to degradation of image quality such as, for example, a decrease in image density or unevenness in image density.

Consequently, in the image forming apparatus 10, restraint members 350 that restrain the developers from moving toward the developing rollers 310 as a result of being transported by the first transport units 322 are provided so as to restrain the developers that have been separated from the developing rollers 310 from moving toward the developing rollers 310.

As illustrated in FIG. 2, each of the restraint members 350 includes plural (e.g., three) plate-shaped members 352. In the developing device body 302, each of the plate-shaped members 352 is disposed in a state of being inclined such that a portion of the plate-shaped member 352 adjacent to the developing roller 310 is located higher than the other portion of the plate-shaped member 352 adjacent to the first transport unit 322 in the direction of gravity.

In the following description, when it is necessary to distinguish the three plate-shaped members 352, the three plate-shaped members 352 will be referred to as the plate-shaped member 352*a*, the plate-shaped member 352*b*, and the plate-shaped member 352*c*.

Among the three plate-shaped members 352, the plate-shaped member 352*a* that is located at the highest position is fixed in place in the developing device body 302 as a result of the upper end of the plate-shaped member 352*a* being attached to a surface of the second body portion 302*b*, the surface facing downward. Accordingly, when the second body portion 302*b* is removed from the first body portion 302*a*, the plate-shaped member 352*a* is removed integrally with the second body portion 302*b* from the first body portion 302*a*. Note that the second body portion 302*b* and the plate-shaped member 352*a* may be integrally formed.

As described above, since the second body portion 302*b* and the plate-shaped member 352*a* are integrally removed from the first body portion 302*a*, in the state where the second body portion 302*b* and the plate-shaped member 352*a* have been removed from the first body portion 302*a*, a space in which no member is disposed is formed between the first transport unit 322 and the outside of the developing device body 302.

Among the three plate-shaped members 352, the plate-shaped member 352*b* that is positioned in the middle in a height direction and the plate-shaped member 352*c* that is located at the lowest position in the height direction are fixed in place in the image forming apparatus body 12 as a result of the left end and the right end of each of the plate-shaped member 352*b* and the plate-shaped member 352*c* being respectively attached to a left inner wall (not illustrated) of the first body portion 302*a* and a right inner wall (not illustrated) of the first body portion 302*a*.

The upper surface of the plate-shaped member 352*b* and the upper surface of the plate-shaped member 352*c* are used as guide surfaces that guide the developer that has been separated from the developing roller 310 toward the first transport unit 322.

The spaces between adjacent ones of the plate-shaped members 352 are used as guide paths 354 that guide the developer that has been separated from the developing roller 310 toward the first transport unit 322.

Figure 3:
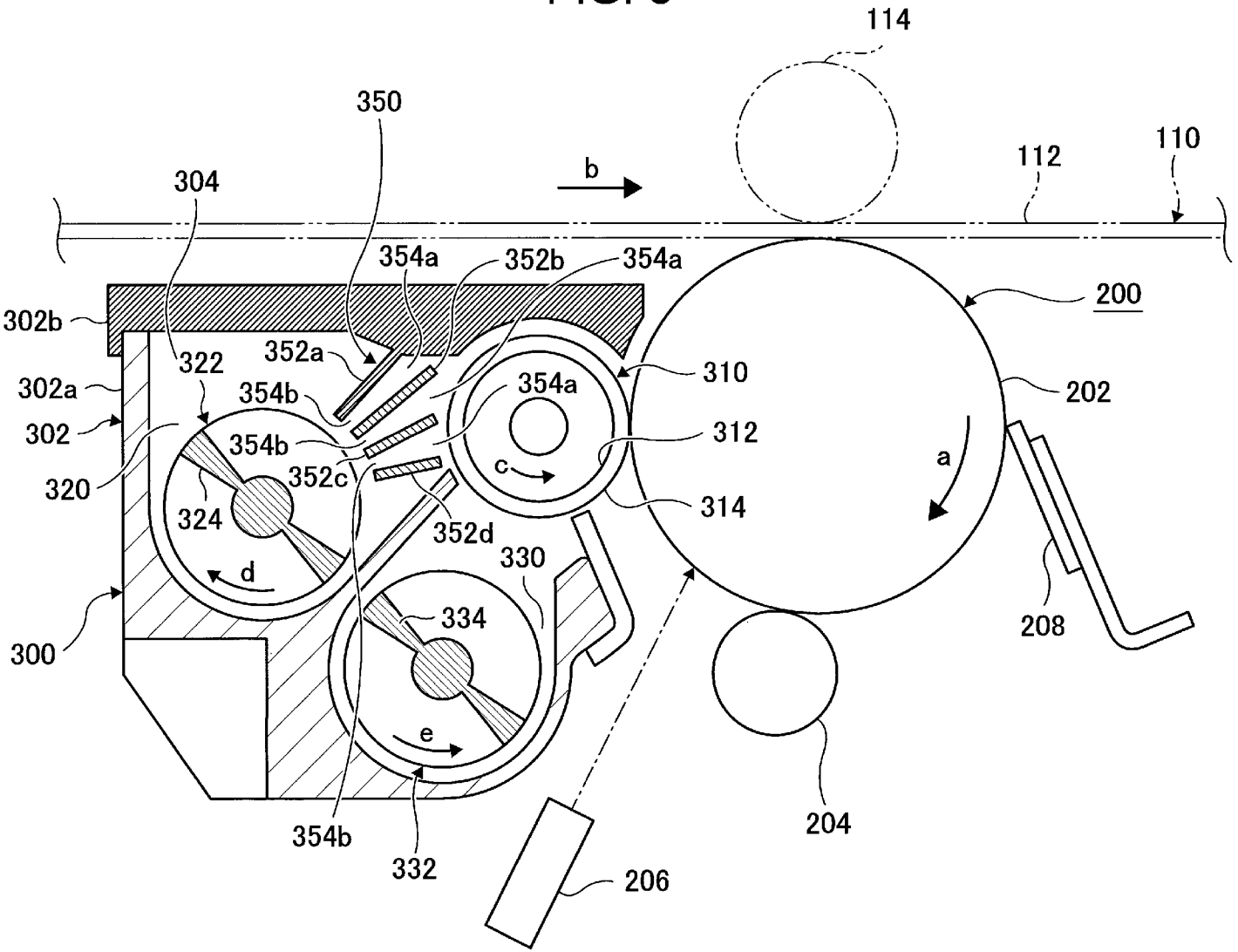
FIG. 3 is a cross-sectional view illustrating a modification of one of the toner-image forming units included in the image forming apparatus illustrated in FIG. 1.

FIG. 3 illustrates a modification of one of the developing devices 300. In the above-described first exemplary embodiment, each of the restraint members 350 includes the three plate-shaped members 352*a*, 352*b*, and 352*c*. In contrast, in the present modification, each of the restraint members 350 includes four plate-shaped members 352*a*, 352*b*, 352*c*, and 352*d*.

Among the four plate-shaped members 352, the plate-shaped member 352*a* that is located at the highest position is fixed in place in the developing device body 302 as a result of the upper end of the plate-shaped member 352*a* being attached to an upper inner wall of the second body portion 302*b*. The other three plate-shaped members 352, which are the plate-shaped members 352*b*, 352*c*, and 352*d*, are fixed in place in the image forming apparatus body 12 as a result of the left end and the right end of each of the plate-shaped members 352*b*, 352*c*, and 352*d* being respectively attached to the left inner wall (not illustrated) of the first body portion 302*a* and the right inner wall (not illustrated) of the first body portion 302*a*.

In the above-described first exemplary embodiment, the three plate-shaped members 352*a*, 352*b*, and 352*c* are arranged approximately parallel to one another. In contrast, in the present modification, the four plate-shaped members 352*a*, 352*b*, 352*c*, and 352*d* are arranged in a fan-like shape in such a manner that openings 354*a* of the guide paths 354 on the side on which the developing roller 310 is disposed are larger than openings 354*b* of the guide paths 354 on the side on which the first transport unit 322 is disposed.

The configuration according to the above-described first exemplary embodiment and the configuration according to the present modification are the same, except with regard to the matter described above. Consequently, the description of the configuration common to the above-described first exemplary embodiment will be omitted.

Figure 4:
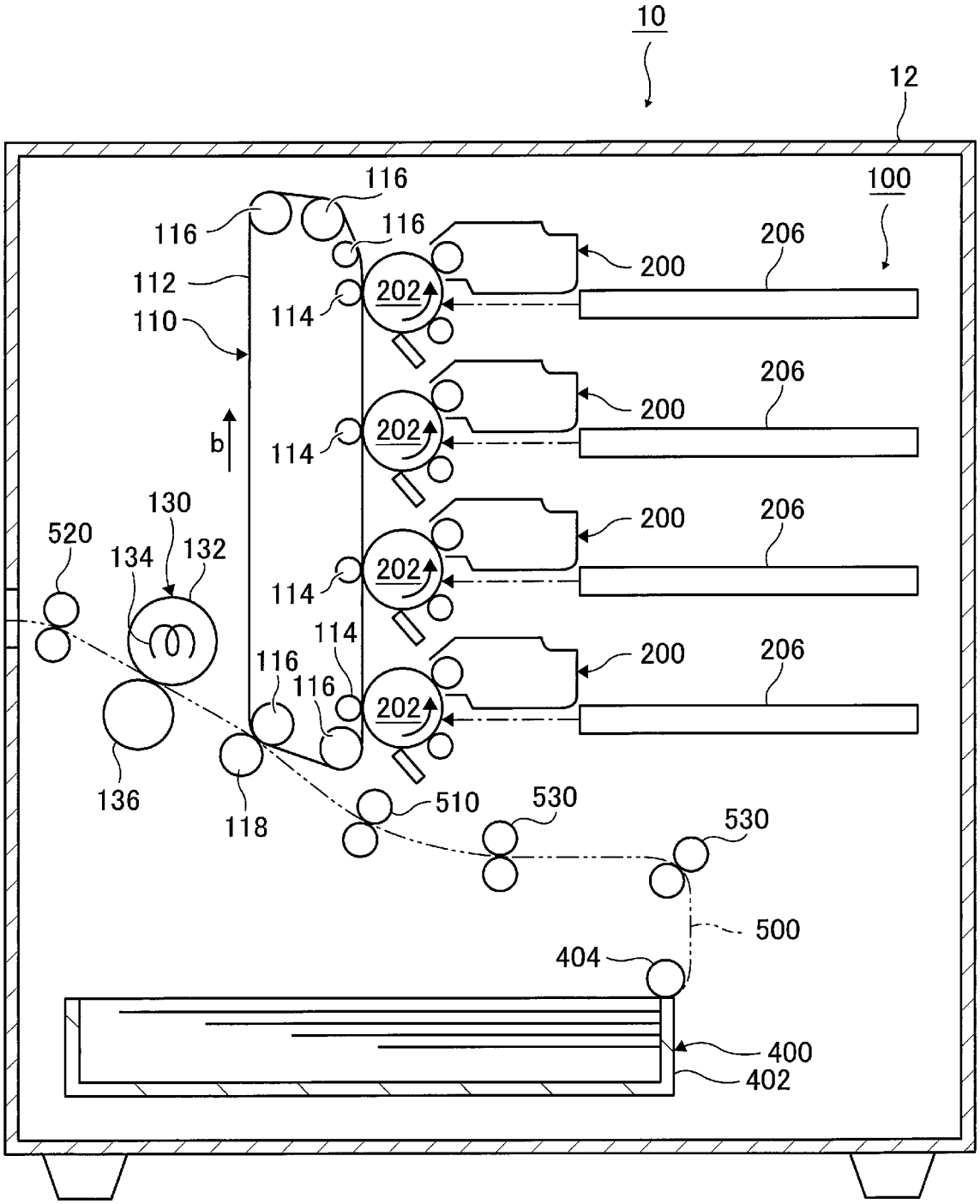
FIG. 4 is a diagram illustrating a schematic configuration of an image forming apparatus according to a second exemplary embodiment of the present invention.

FIG. 4 illustrates the image forming apparatus 10 according to a second exemplary embodiment of the present invention. In the above-described first exemplary embodiment, the four toner-image forming units 200 are arranged in a substantially horizontal direction. In contrast, in the second exemplary embodiment, the four toner-image forming units 200 are arranged in a substantially vertical direction.

In the above-described first exemplary embodiment, the intermediate transfer body 112 is stretched in such a manner that the length thereof in the horizontal direction is longer than the length thereof in the vertical direction. In contrast, in the second exemplary embodiment, the intermediate transfer body 112 is stretched in such a manner that the length thereof in the vertical direction is longer than the length thereof in the horizontal direction.

In the above-described first exemplary embodiment, the image forming apparatus 10 includes the three support rollers 116. In contrast, in the second exemplary embodiment, the image forming apparatus 10 includes five support rollers 116. In the above-described first exemplary embodiment, no transport roller is disposed between the delivery roller 404 and the registration rollers 510. In contrast, in the second exemplary embodiment, two pairs of transport rollers 530 are disposed between the delivery roller 404 and the registration rollers 510.

The configuration according to the second exemplary embodiment is the same as the configuration according to the above-described first exemplary embodiment, except with regard to the matter described above and the configuration of each of the developing devices 300, which will be described below. Consequently, the description of the configuration common to the above-described first exemplary embodiment will be omitted.

Figure 5:
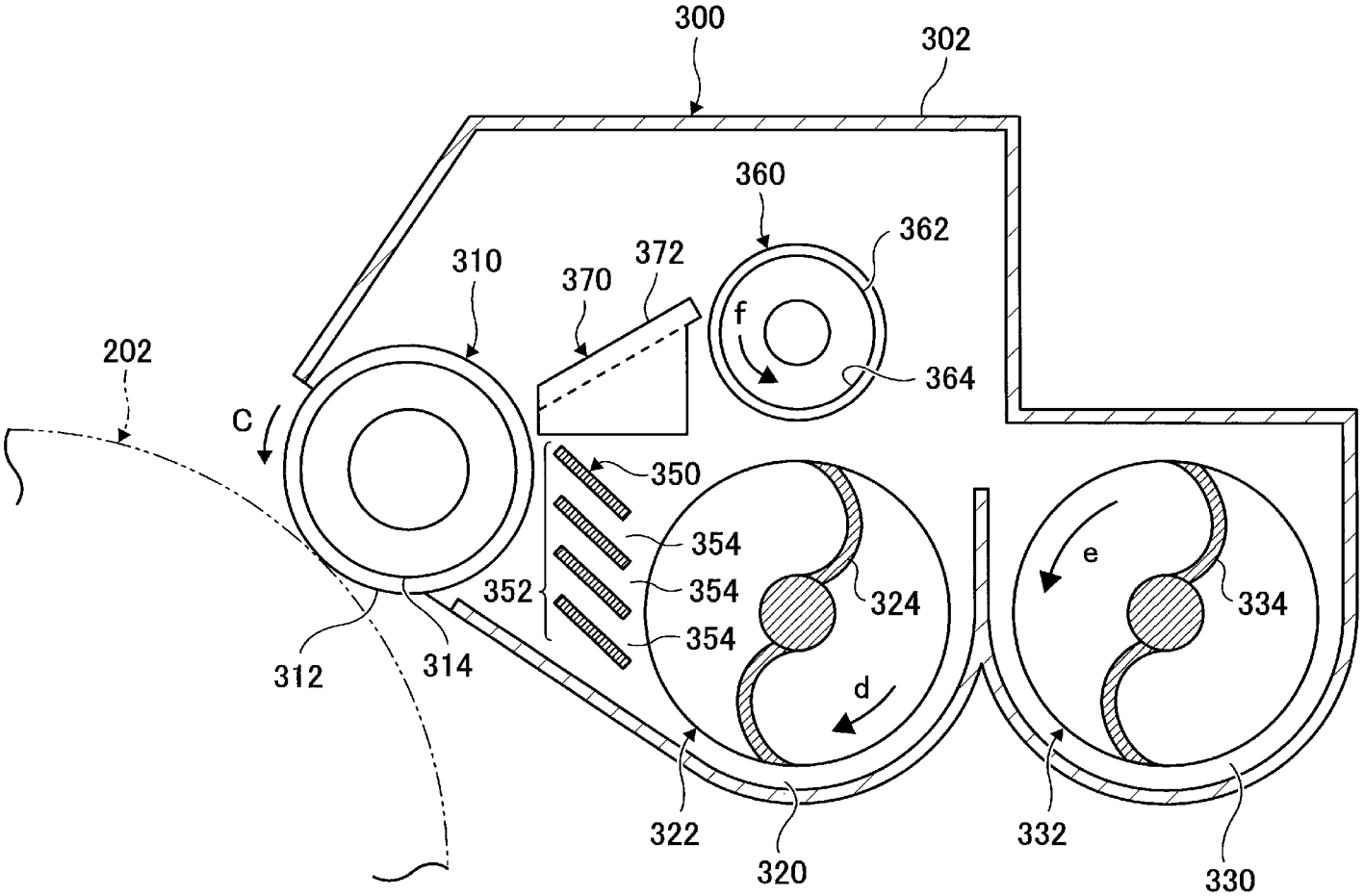
FIG. 5 is a cross-sectional view illustrating an example of one of developing devices included in the image forming apparatus illustrated in FIG. 4.

FIG. 5 illustrates one of the developing devices 300 according to the second exemplary embodiment. Similar to the above-described first exemplary embodiment, in the second exemplary embodiment, each of the developing devices 300 includes the developing roller 310, the first transport unit 322 disposed in the first stirring chamber 320, the second transport unit 332 disposed in the second stirring chamber 330, and the restraint member 350. In addition, in the second exemplary embodiment, each of the developing devices 300 further includes a developer transport roller 360 and a developer guide member 370.

The developer transport roller 360 is a member that draws and transports the developer by attracting the developer at a position facing the first transport unit 322 and causing the developer to separate therefrom in the vicinity of the developer guide member 370. The developer transport roller 360 includes a magnet member 362 having, for example, a columnar shape and a transport sleeve 364 having, for example, a cylindrical shape. The transport sleeve 364 covers the magnet member 362 and rotates in the direction of arrow f while being supported by the magnet member 362.

The developer guide member 370 has a guide surface 372 that is inclined in such a manner that a portion of the guide surface 372 adjacent to the developer transport roller 360 is located higher than the other portion of the guide surface 372 adjacent to the developing roller 310 in the direction of gravity, and the guide surface 372 guides the developer separated from the developer transport roller 360 toward the developing roller 310.

Similar to the above-described first exemplary embodiment, the restraint member 350 includes the plate-shaped members 352, and surfaces of the plate-shaped members 352, the surfaces facing upward, are used as guide surfaces that guide the developer from the developing roller 310 toward the first transport unit 322. The spaces between adjacent ones of the plate-shaped members 352 are used as the guide paths 354.

Similar to the above-described first exemplary embodiment, in the second exemplary embodiment, the restraint member 350 makes it difficult for the developer that has been separated from the developing roller 310 and that has spattered as a result of being transported by the first transport unit 322 and scattered in the developing device body 302 to come near the developing roller 310 and causes the developer that has been separated from the developing roller 310 to be deposited at a position far from the developing roller 310.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that holds a developer to be supplied to an image carrier that holds an image;

a transport member that transports the developer in an axial direction of the developer carrier; and a plurality of restraint members that restrain the developer, which has scattered as a result of being transported by the transport member, from moving toward the developer carrier, wherein the restraint members are disposed between the developer carrier and the transport member.

2. An image forming apparatus comprising:

an image carrier that holds an image;

a developer carrier that holds a developer to be supplied to the image carrier;

a transport member that transports the developer in an axial direction of the developer carrier; and a plurality of restraint members that restrain the developer, which has scattered as a result of being transported by the transport member, from moving toward the developer carrier, wherein the restraint members are disposed between the developer carrier and the transport member.

3. The image forming apparatus according to claim 2 wherein each of the restraint members has a guide surface that guides the developer separated from the developer carrier toward the transport member.

4. The image forming apparatus according to claim 2 wherein any adjacent two of the restraint members has a guide path that guides the developer separated from the developer carrier toward the transport member, and wherein an opening of the guide path facing the developer carrier is larger than an opening of the guide path facing the transport member.

* * * * *